US005383516A

United States Patent [19]

Dinulescu

[11] Patent Number: 5,383,516

[45] Date of Patent: Jan. 24, 1995

[54] HEAT EXCHANGER APPARATUS

[76] Inventor: Mircea Dinulescu, Groen van Prinstererlaan 37, NL-2271 EM Voorburg, Netherlands

[21] Appl. No.: 66,078

[22] PCT Filed: Nov. 21, 1991

[86] PCT No.: PCT/NL91/00236

§ 371 Date: May 24, 1993

§ 102(e) Date: May 24, 1993

[87] PCT Pub. No.: WO92/09859

PCT Pub. Date: Jun. 11, 1992

[30] Foreign Application Priority Data

Nov. 23, 1990 [CA] Canada ..... 2030577

[51] Int. Cl.[6] ..... F28D 9/00

[52] U.S. Cl. ..... 165/82; 165/166

[58] Field of Search ..... 165/82, 166

[56] References Cited

U.S. PATENT DOCUMENTS

| | | | |
|---|---|---|---|
| 1,409,967 | 3/1922 | Prat | 25/166 |
| 3,241,607 | 3/1966 | Rutledge | 165/166 |
| 3,494,419 | 2/1970 | Warner | 165/82 |
| 4,263,964 | 4/1981 | Masai et al. | 165/67 |
| 4,331,352 | 5/1982 | Graves | 285/226 |
| 4,377,025 | 3/1983 | Masai et al. | 29/434 |
| 4,596,285 | 6/1986 | Dinulescu | 165/82 |
| 4,805,695 | 2/1989 | Ishikawa et al. | 165/82 X |
| 4,848,450 | 7/1989 | Lapkowsky | 165/166 |

FOREIGN PATENT DOCUMENTS

| | | |
|---|---|---|
| 752733 | 2/1967 | Canada . |
| 0117565 | 9/1984 | European Pat. Off. . |
| 0265528 | 5/1988 | European Pat. Off. . |
| 1037568 | 9/1953 | France . |
| 1125663 | 11/1956 | France . |
| 2628194 | 9/1989 | France . |
| WO83/03663 | 10/1983 | WIPO . |

*Primary Examiner*—Stephen M. Hepperle
*Attorney, Agent, or Firm*—Foley & Lardner

[57] ABSTRACT

A heat exchanger apparatus (20) of the type having a rigid, unitary, parallel piped shaped core (21) mounted in a frame (22) defining support areas for the core. The core (21) is formed of a plurality of thin parallel plates (30, 30a) defining alternating passages (32, 34) for two different gas flows. Each plate (30) is connected to an adjacent plate by parallel elongated bars (31, 33) along side edges thereof, the bars being of stronger construction than the plates. The core (21) has four vertical corners, a pair of lower transverse corners and a pair of upper transverse corners. The frame (22) includes a pair of spaced parallel plates (23) and transverse structural connectors (24). Seal means (45, 46, 70) are provided both between the vertical corners (41) and the transverse corners (51) of the core (21) and the adjacent surfaces (26) of the frame defined by the pair of plates (23) and by the structural connectors (24).

10 Claims, 6 Drawing Sheets

20
21
22
23
24
25
26
27
28
30
30a
31
32
33
34
36
37
38
40
41
42
43
A
B
B'
3'

HEAT EXCHANGER APPARATUS

This invention relates to a heat exchanger apparatus, such as plate type heat exchangers of the type using a cross flow system.

Heat exchangers of the type including a plurality of spaced, parallel metal plates, which provide therebetween alternative gas flow passages, are well known and commonly used, for example, in transferring heat from hot combustion exhaust gases to combustion air being fed into a combustion area. The heat exchanger may include a plurality of plate modules positioned in a duct work system for conducting the exhaust gases and intake air through the modules on separate flow paths which are at right angles to each other. The system includes a frame work for supporting the plate modules or core units formed by the plurality of plates. When the heat exchanger is subject to hot gases during operation, the core unit expands relative to the frame work, and depending on design and quality of the core unit, they are subjected to distortion to some degree. The core units may be prefabricated as an integral unit such as that shown in Canadian Patent No. 752,733, granted Feb. 14, 1967 to Koch, or they may be installed in the form of a pack of space parallel plates which are not fastened together, but wherein the pack is compressed by end walls such as shown in U.S. Pat. No. 4,596,285, granted Jun. 24, 1986 to Dinulescu.

It is important that there be a minimum of leakage from one path of gas flow to the other, and various forms of gas seals have been developed for use between the edges of the core units and the frame, many of which have not been fully effective particularly over a period of time, and/or are of elaborate design and thus expensive to manufacture and install. Because of the relationship between the core and supporting frame and of the manner in which the seals are designed to cooperate with the core unit in some known heat exchangers, there is required a rather complicated procedure of assembly of the frame about the core.

It is an object of the present invention to provide an economic heat exchanger of the cross flow type wherein a rigid unitary parallelpipe shaped core is provided which has a sealing system allowing installation of the core into an integral frame structure which results in an effective seal between the two paths of gas flow through the heat exchanger.

According the heat exchanger of the present invention, there is provided a rigid, unitary parellelpipe shaped core, and an integral frame containing the core with seal means between the core and the frame. The core is formed by attached, space, parallel plates providing there-between a plurality of alternating cross flow paths for two different gases, the flow of a first gas of one temperature being horizontally through the core between fore and aft ends of the core and the flow path of a second gas of a different temperature being through the core between a first pair of opposite sides of the core disposed at right angles to the fore and aft ends of the core. The plurality of plates include a pair of outer plates and a plurality of inner plates between the pair of outer plates which have outer side surfaces defining a second pair of opposite sides of the core disposed at right angles to the ends of the core and to the first pair of sides of the core. Each inner plate is affixed to an adjacent plate on one side at horizontal edges thereof by a first pair of elongated edge bars thereby defining with the adjacent plate on that one side a flow passage for the first gas moving through the core between the fore and aft ends of the core. Each inner plate is further affixed to an adjacent plate on the other side thereof by a second pair of elongated edge bars disposed at right angles to the first pair of bars thereby .defining with the adjacent plate on the other side a flow passage for the second gas moving through the core at right angles to the flow passage of the first gas and between the second pair of opposite sides of the core. The core has four vertical corners, a pair of lower of transverse corner edges and a pair of upper transverse corner edges. The frame includes a pair of panels joined by spaced elongated structural connectors, the panels being disposed adjacent the pair of outer plates of the core and having inner surfaces adjacent the outer side surfaces of the outer plates. The frame provides means supporting the core thereon and defines lower surface areas outwardly of the lower pair of transverse corner edges of the core, in the fore and aft directions, upper surfaces opposed to and spaced above the lower surface areas a distance greater than the height of the core to allow for expansion of the core in a vertical direction, and opposed inner side surface areas adjacent to and spaced transversely outward from the four vertical corners of the core to allow for transverse thermal expansion of the core. The seal means is attached between the core and the frame and includes a first set of seals including elongated seal members positioned between each of the vertical corner edges of the core and the inner side surface areas defined by the frame,-a second set of seals including a pair of elongated seal members joining the upper transverse corner edges of the core and the upper surfaces of the frame, the first and second sets of seals accomodating thermal expansion and contraction of the core in the transverse, vertical and fore and aft directions relative to the frame. A third set of seals is provided which includes a pair of elongated seals joining the lower transverse corner edges of the core to the lower surface areas defined by the frame and accomodating movement of the lower transverse corner edges in a fore and aft direction on the lower surfaces which supports it and also expansion of the lower edges in a transverse direction relative to the lower surface areas provided by the frame.

In the accompanying drawings, which illustrate examples of the present invention, FIG. 1 is a perspective view of the core and frame in separated condition, FIG. 2 is a perspective view of the core and frame of FIG. 1 in an assembled condition;

Figure 1:
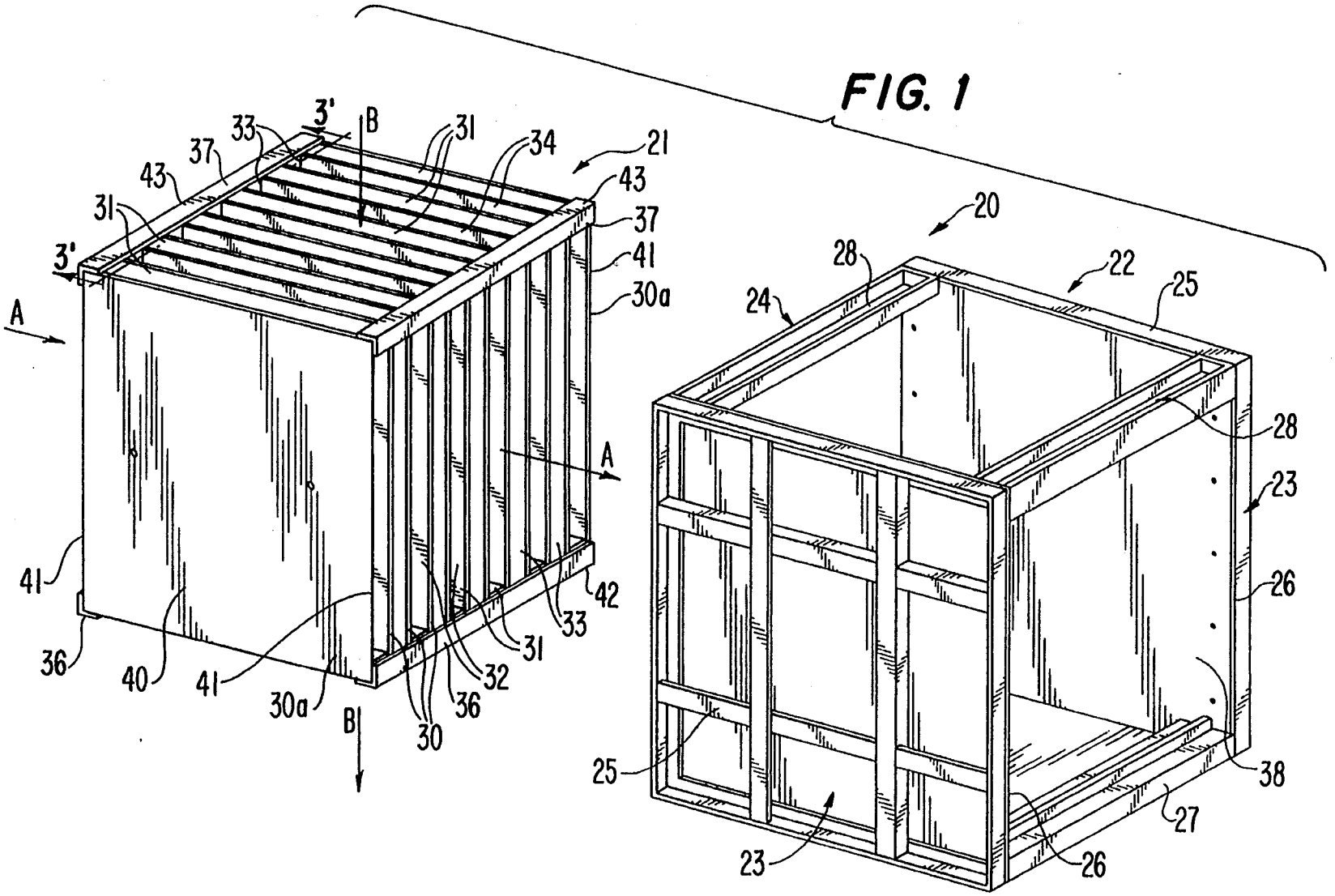
Figure 2:
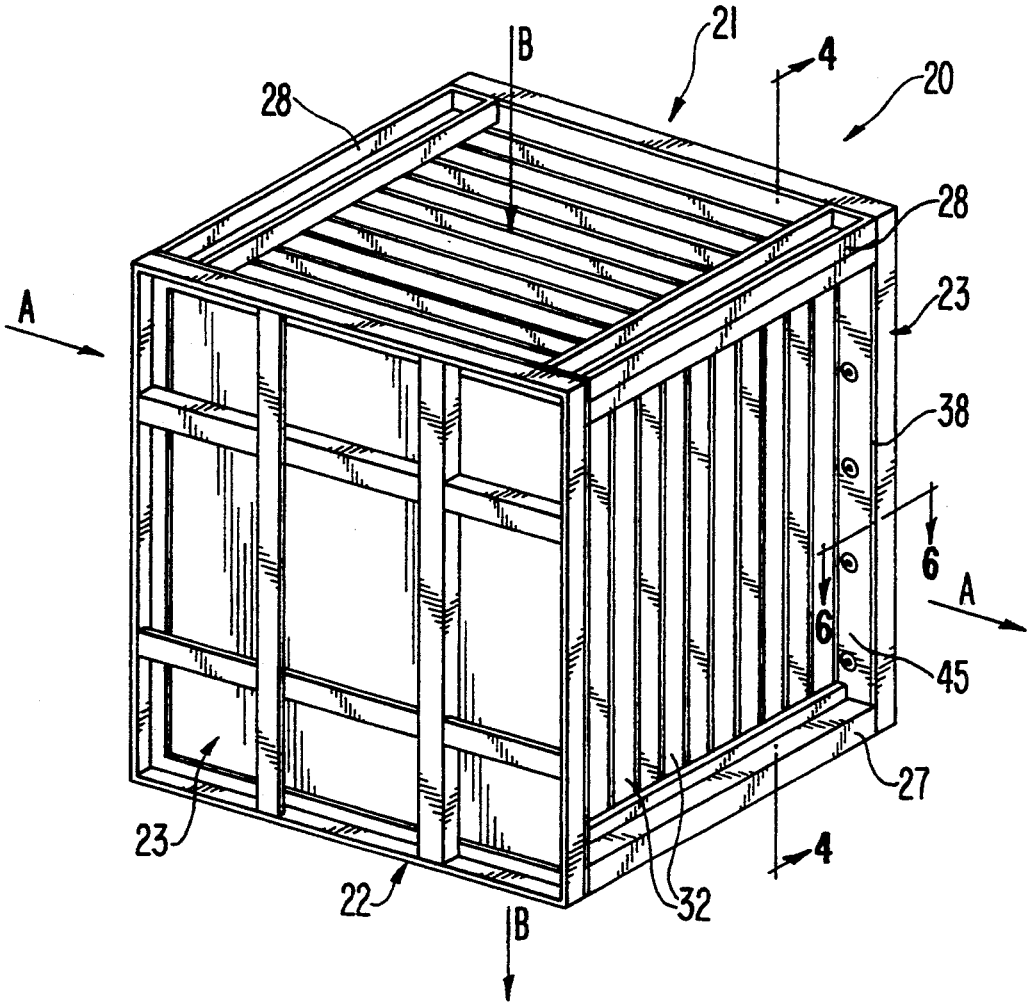

In FIGS. 1 and 2, the reference character 20 generally denotes the heat exchanger of the present invention which includes a core 21 and a frame 22. It should be appreciated that while the frame 22 is illustrated as comprising a unit of a size to simply contain the core 21, the frame 22 may form a portion of a larger frame system for containing a plurality of cores and being coexistent with ductwork for conducting gases through the core and through other cores in parallel or series with core 21. It is also to be realized that the core 21 and frame 22 are constructed separately and then assembled with the seal means which are described below being affixed between the core and frame as described later in more detail.

In the embodiment of the invention shown in FIGS. 1 and 2, the frame 22 is an integral unit which includes a pair of spaced, parallel panels 23 connected by structural connectors 24. The panels are shown as forming side walls made up of a rigid frame work 25 to which there is welded on the inside surface thereof plates 26. The framework 25 may be formed of a plurality Of steel structural members such as angle irons, channels or box shaped sections which are welded together. The structural connectors 24 include a lower pair of spaced transverse beams 27 and an upper pair of spaced transverse beams 28 in the embodiment of the invention shown in FIGS. 1 and 2.

The core 21 is in the form of a rigid unitary parallelpiped member formed by attached, spaced, parallel plates 30, which are shown as being vertically disposed. The plurality of plates include outer plates 30*a* with the plurality of inner plates 30 contained therebetween. The inner plates 30 are affixed to an adjacent plate on one side thereof along its horizontal edges, i.e. the top and bottom edges as seen in FIG. 1, by a pair of elongated horizontal bars 31 so that there is provided between that plate and the adjacent plate, flow passage 32 for a first gas. The plurality of passages 32 thus formed provide a horizontal gas flow path through the core as indicated by arrows A.

Each inner plate is also affixed to an adjacent plate on the other side thereof by a second pair of elongated bars 33 extended along the vertical edges of the plates so as to provide on the opposite side of each plate a flow passage for a second gas of a different temperature than the first. The plurality of passages 34 thus formed alternatively between plates 30 provide the flow path in the direction of the arrows B for the second gas. Thus, there is provided a plurality of alternating cross flow pass for two different gases, the flow path A of the first gas being at one temperature and is in the horizontal direction through the core between the fore and aft sides of the core and the flow path B for the second gas of a different temperature is through the core between the a pair of opposite sides of the core disposed at right angles to the fore and aft ends, and in the present described embodiment, these sides are the top and bottom sides of the core.

Figure 3:
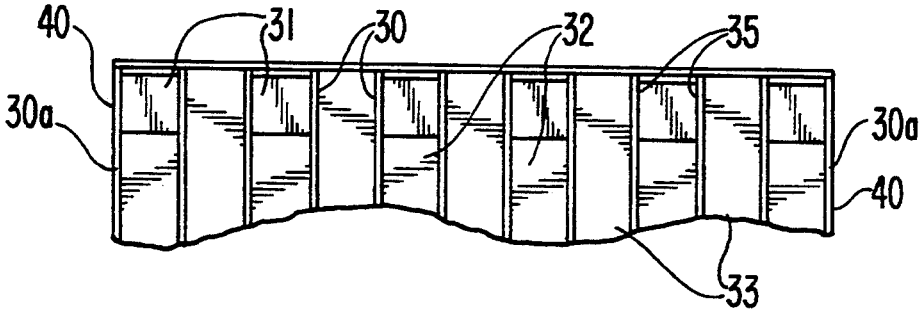
FIG. 3 is a partial sectional view of the upper portion of the core as seen from the line 3—3 of FIG. 1.

In FIG. 3, there is illustrated one manner in which the plates 30 may be affixed to the bars 31 which is positioned therebetween along the upper edges, such as by welding 35. The manner in which the plates may be welded to the bars 31, and also to the vertical bars 33 will be described in more detail below. As all of the plates are welded to the spacer bars which are located between it and an adjacent plate, a core is formed as a solid unit prior to installation. As is apparent from FIG. 1, there is provided on the lower transverse corners of the core, a pair of angle irons 36 which are welded to the core. Similarly, a pair of angle irons 37 are welded to the core along the upper transverse corners so as to make the entire unit more rigid and to provide smooth outer surfaces for attachment of the seals as will be described below. The core may be made of any size, and may be made of different widths in the transverse direction as shown in FIGS. 1 and 2 by utilizing different numbers of plates. The width of the flow passages 32 and 34 are determined, of course, by the width of the spacer bars 31 and 33 utilized.

As can be seen in FIG. 2, the panels 23 are vertically disposed in the presently illustrated embodiment of the invention with the lower transverse beams 27 and upper transverse beams 28 extending transversely therebetween and spacing inner wall surfaces 38 of the panel a distance slightly greater than the total transverse width of the core 21 so that as the core is heated during operation, there is sufficient room to allow for its transverse expansion. The outer plates 30*a* of the core define outer side surfaces 40 of the core, and when the core is positioned within the frame, the side surfaces 40 are located immediately inwardly of the inner surfaces 38 of the side panel 23. The parallelpiped core thus has four vertical corners 41, a pair of lower transverse corners 42 and a pair of upper transverse corners 43. The fore and aft sides of the core are defined within the vertical corners 41 and the lower and upper transverse corners 42 and 43 at the entry and exit sides of the core. The fore and aft sides of the core are shown as being vertically disposed, and when installed in the frame are positioned between the lower and upper transverse beams 27 and 28 of the frame. The second pair of side surfaces of the parallelpiped core are the top and bottom sides which are exposed respectively to the space between the pair of upper transverse beams 28 and between the space between the pair of lower transverse beams 27 when the core is installed in the frame. The third pair of sides of the parallelpiped core, which are perpendicular both to the fore and aft sides and to the top and bottom sides of the core are defined by the sides surfaces 40 of the outer plates 30*a*. The flow of the first gas through the core, as indicated above, is horizontally through the core and thus passes through the frame in a direction parallel to the panels 23 and between openings defined between the lower transverse beams and the upper transverse beams. The flow of the second gas is between the panels 26 in a direction also parallel to the panels, and in the embodiment shown in a vertical direction passes between the spaces between the upper pair of transverse beams and the space between the pair of lower transverse beams.

Figure 6:
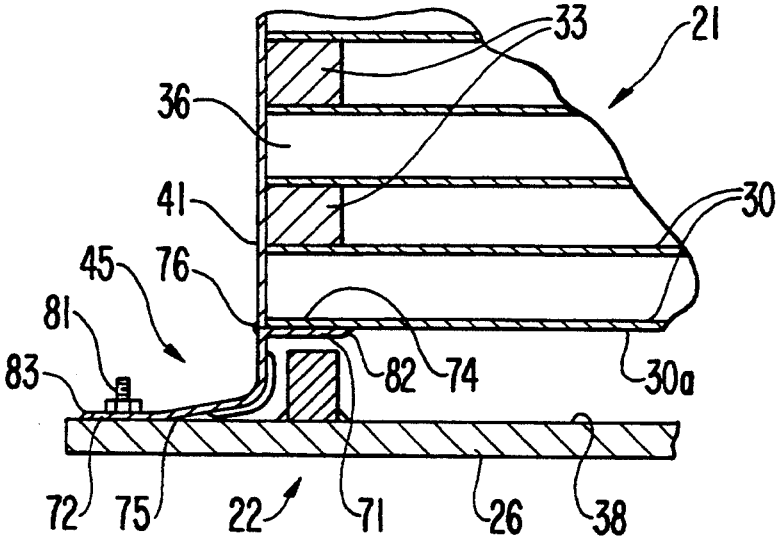
FIG. 6 is a partial sectional view of a corner seal between the core and the frame as seen from the line 6—6 of FIG. 2.

There is provided at the four corners of 41 of the core a set of seals 44 (FIGS. 2 and 6) interconnecting the core at the vertical corners thereof and the inner surfaces 38 of the panels 23 which extend beyond the core in the fore and aft direction of the frame. Another set of seals 45 (FIG. 4) interconnect the upper transverse corners 43 of the core to the upper transverse beams 28, and yet a third set of seals 46 (FIGS. 2 and 4) interconnect the lower transverse corners 42 of the core to the lower transverse beams 27.

Figure 4:
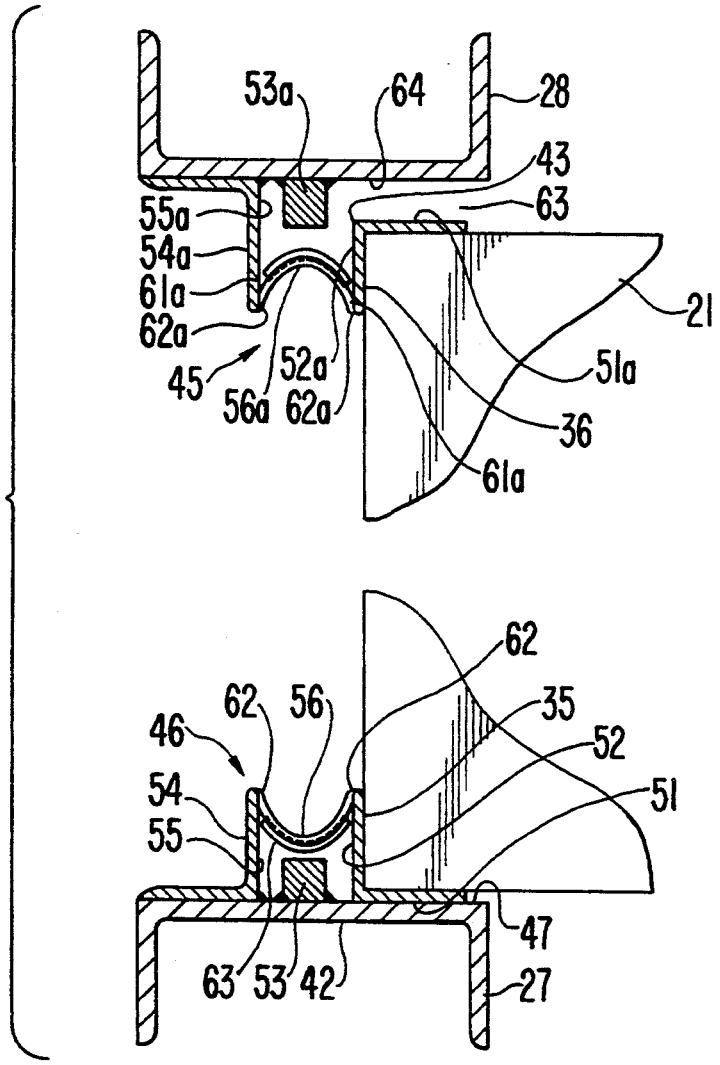
FIG. 4 is a partial sectional view showing the seals at the lower and upper corners between the assembled core and the frame as seen from the line 4—4 of FIG. 2.

The lower transverse beams 27, are spaced in the fore and aft direction of heat exchanger a distance to support the lower transverse corners 42 of the core 21. As best shown in FIG. 4, the channel shape member 27 which is affixed between the panels in an inverted orientation, provide on its upper web a lower surface 47 for supporting the core 21. The angle 35 welded to the lower transverse corner of the core provides a surface 51 which engages and rests on the lower supporting surface 47 of the lower transverse beam 27. The angle 35 also provides a front vertical surface 52 which extends upwardly relative to the surface 51 at right angles thereto.

Figure 5:
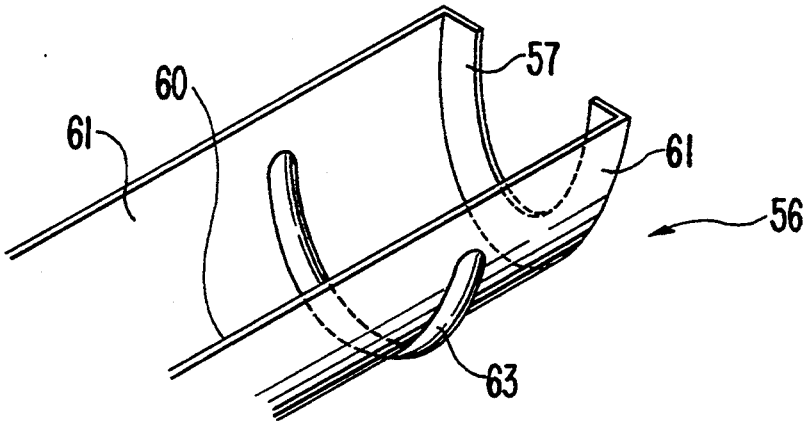
FIG. 5 is an enlarged partial perspective view of the seal member shown in FIG. 4.

Welded on the surface 47 a distance spaced in front of the front vertical surface 52 is a stop member 53 which may be in the form of a solid metal bar. Also welded to the surface 47 on the side of the stop member 53 opposite to the corner of the core is an angle member 54 which provides a vertical surface 55 which is spaced from and opposed to the vertical surface 52. Located between the vertical surfaces 52 and 55 is an elongated transverse seal member 56 which is formed of resilient material. The seal member 56, which extends entirely across the transverse distance between the side panels is a U-shaped member provided at opposite ends with a flange portion 57 which is normal to the elongated axis of the member and is provided for affixing to the inside wall surfaces 37 of the panels 23 by bolting or other means (not shown). The U-shaped cross section provides a curved central portion 60 (FIG. 5) with opposite upwardly extending leg portions 61. The leg portions. 61 are bolted or attached by resistant welding (not shown) between the surfaces 52 and 55 of the upstanding flanges of the angle members 35 and 54. After attachment of the seal member 56 in place, seal weldings 62 are run completely along the upper edges of the legs 61 and the adjacent surfaces 52 and 55 of the angle members 35 and 54 thereby providing a complete seal between the lower transverse corners 42 of the core and the frame, which is the lower transverse beam 27 on which the core is supported. Along the length of the seal member 56 there is provided a series of pressed-in grooves 63 which extend transversely to the longitudinal direction of the seal member. These grooves permit elongation and contraction of the seal member in the longitudinal direction and thus accommodate relative movement of the core in the transverse direction with respect to the frame so as to compensate for the expansion of the core in the transverse direction on being heated. As can also been seen, because the core rests on the lower support surface 47, it is free to slide not only in the transverse direction relative to the frame, but also in the fore and aft direction. Sliding in the fore and aft direction is permitted by the legs 61 of the seal member 56 squeezing toward each other due to bending of the U shape portion of the seal. The movement of the core in the fore and aft direction is unhindered due to the space between the surface 52 of the angle member 35 and the stop member 53 which is opposed to the surface 52. Under extreme conditions, or should be heat exchanger be exposed to any shock conditions, the movement in the fore and aft direction of the core is limited due to the existence of the stop member 53 and thereby avoids damage of the seal member.

As is also apparent from FIG. 4, the upper transverse beam 28 is oriented in the opposite manner as the lower transverse member 27 so that the web thereof provides an upper surface 64 opposed to the lower supporting surface 47 of the transverse beam 27. The vertical distance between the surfaces 47 and 64 is slightly greater than the total height of the core so that there is a gap 63 between an upper surface **51*a* provided by the angle member 36 welded to the upper corner of the core member. There is provided at the upper transverse corner 43 of the core the seal means 45 which is formed of elements similar to those used in forming the lower seal 46. A stop member 53*a* is welded to the surface 64 between the upper transverse corner 43 of the core and an angle member 54*a* welded to the lower surface 64 and provides a vertical surface 55*a* which is opposed to a vertical surface 52*a* provided by the angle member 36. A seal 56*a*, which may be of the same configuration of the seal 56 is located and attached in position in the same manner as the seal 56. When fixed in position, there are provided weld seal lines 62*a* between the leg portions 61*a* of the seal member and the surfaces 55*a* and 52*a* of the angles 54*a* and 36, respectively. The seal 56*a* allows for both movement of the core in the fore and aft direction and also in the transverse direction of the core due to expansion. Also, as the core is heated, it expands in the vertical direction which is also accommodated by the seal member 56 in that there is in effect a slight rolling action of the central portion 60 of the seal relative to the legs 61 as the surface 52*a* moves upwardly and downwardly relative to the vertical surface 55*a***.

Figure 7:
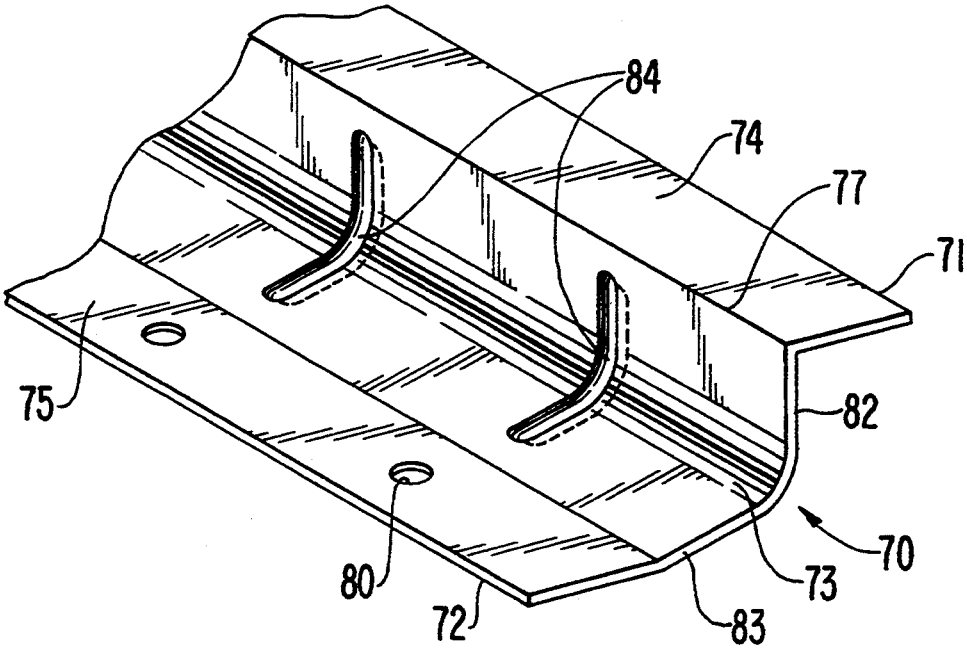
FIG. 7 is a perspective view of a portion of the seal shown in FIG. 6.

The structural connectors 24 and 25 may be of a shape different than the channel members shown, and it may be seen that seals of the configuration shown as 56 may be used regardless of whether the structural connectors are in the form of angle irons, box sections or of other shape, it being only necessary to provide a vertical member which has a surface which is substantially parallel to and spaced in front of the surfaces **52,52*a* provided by the angle irons 35 and 36 affixed to the transverse corners of the core 21. 0n the other hand, a seal member 70 is used in the set of seals at the vertical corners of the core member in the present embodiment, the seal member 70 being more of a Z-shaped cross section is practical for use between spaced parallel surfaces, such as the outer surface 40 provided by the outside side surface of the outer plate 30*a* of the plates making up the core and the inner wall surface 38 of the plate 26 included in the panel 23. The seal member 70 (FIG. 6 and 7) is provided with edge areas or flanges 71 and 72 which are disposed in spaced parallel planes joined by a central curved or bent portion 73. Flange 71 provides an outer flat surface 74 and edge flange 72 provides an outer flat side surface 75. The seal member 70 is attached by a connecting weld 76 located at the vertical corner 41 of the core and a corner 77 (FIG. 7) of the seal member between the flange 71 and the central portion. The flange 72 may be provided with bolt hole openings 80 so that while the seal member 70** may be affixed to the core before installation into the frame 22, after the core is placed in position resting on the lower transverse beams 27, the flange 72 is bolted to the plate 26 of the side panel of the frame by way of bolts 81 (FIG. 6) passing through the openings 80 and aligned holes (not shown) in the plate 26. Prior to installation of the core in the frame, a seal weld 82 can be run along the outer edge of the flange 74. After installation into the frame, a seal weld 83 is run along the outer edge of the flange 72. The central portion 73 of the seal member 70 is of an open V-configuration provided by a first portion 82 extending away from the flange 71 and a second portion 83 extending away from the flange 72 at an angle, the portions 82 and 83 being joined at an obtuse angle thereby forming the open V-configuration. In the embodiment shown, the portion 82 of the central portion extends away from the flange 71 substantially at a right angle while the portion 83 extends away from flange 72 at an obtuse angle.

The seal member 70 is formed of spring steel and is elongated so as to extend the height of the core and to meet at its opposite ends with the transverse seals 56 and 56*a* (FIG. 4). Along the length of the seal member 70 there are provided pressed-in transverse grooves 84 which allow some movement of the flanges 71 and 72 relative to each other in the longitudinal direction of the seal member 70. Because of the substantially perpendicular direction of the portion 82 in the central portion of the seal member away from the flange 71, it can be seen that the core 21 may expand and contract in the fore and aft direction of the core, this movement imparting some bending of the portion 82 about the angle which it forms with the flange 71. Moreover, the core may expand in the transverse direction because of the portion 83 which extends away from the inner surface 38 at a slight angle. This expansion would cause slight bending of the portion 83 at the angle connection between the portion 83 and the flange 72. Expansion or contraction of the core in the vertical direction causes movement of the flange 71 relative to the flange 72 in a direction parallel to the longitudinal direction of the seal, this later movement being accommodated by the pressed-in grooves which avoids stress fatigue in the central portion 83 of the elongated member.

In the core structure 21 shown above, the plates 30 may be formed of relatively weak steel plate material, and in the case of excess stress will buckle slightly, but overall, the plates play a negligible role in the strength of the unitary core structure. The edge bars 31 and 33 are stronger than the plates and in the main control the movement of the plates. The plates follow the thermal deformation of the edge bars and provide virtually no resistance against this deformation. In the present invention there are provided, of course, stiffened corners because of the presence of the angle iron members 36 and 37 which extend transversely of the core member at both the lower transverse corners 42 and the upper transverse corners 43, respectively. The angle irons function as rigid elements which do not bend as a result of any differential thermal expansion of the edge part. Thus, the only displacement of the corners relative to the core is that of the linear thermal expansion in nature.

Figure 11:
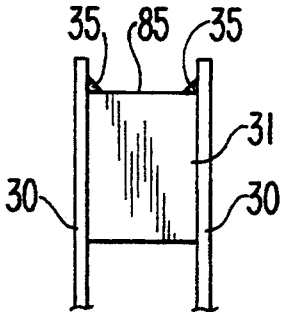
FIG. 11 is a sectional view showing a connection arrangement between adjacent plates of the core and a connecting bar located therebetween.
Figure 14:
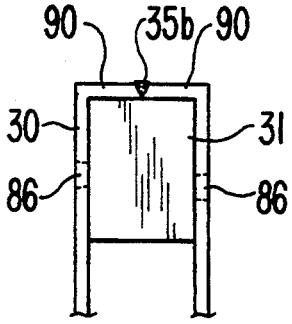
FIGS. 13 and 14 are sectional views similar to FIG. 11 but showing alternative connection arrangements.
Figure 13:
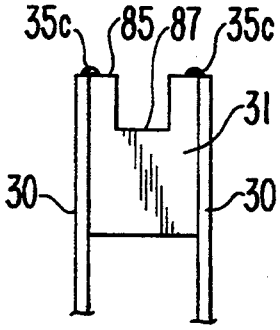
Figure 12:
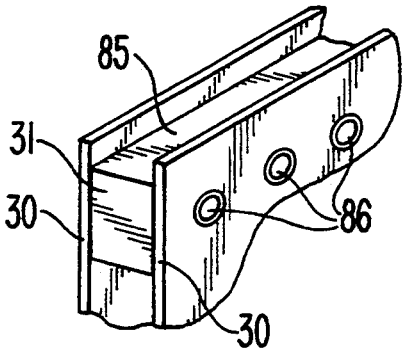
FIG. 12 is a perspective view of a connection arrangement as an alternative or an addition to that shown in FIG. 11.

One manner of connecting the plates to the edge bars 31 and 33 is as shown in FIGS. 3 and 11. The bars 31 maybe a solid steel bar, as shown, or a rectangular tube. An economical method of welding the plates 30 on the opposite sides of the bar 31 is to allow the plates 31 to extend slightly outwardly from outer surface 85 of the bar. Continuous seal welds 35 are then run along the entire length of the bar in the internal corners provided as shown. As illustrated in FIG. 12, spot welding 86 may be carried out from the outer sides of the plate along the length of the bar 30, the spot welding 86 being carried out by either electrical resistance welding or arch welding to provide added structural strength of the plate-bar joint. In the embodiment shown in FIG. 13, the bar 31*a* is provided with a groove 87 extending inwardly of the face 85 along the entire length of the bar 31*a*. In this embodiment, the outer edges of the plates 30 are flush with the outer surface 85 of the bar 31*a*. The groove or channel 87 is provided in the outer edge surface 85 of the bar 31*a* so as to prevent rapid cooling of the seal welds 35*a* which are applied along the outer edges of the plates and the adjacent surface 85 of the edges of the bars. In the embodiment shown in FIG. 14, the plates 30 are shown attached to the bar 31 by spot welds 86 as described above, but the plates 30 have outer edge portions thereof 90 bent at right angles to overlie the outer edge surface 85 of the bar 31, with inner edges of the bent over portions 90 being slightly spaced for reception of a seal weld 35*b*.

Figure 15:
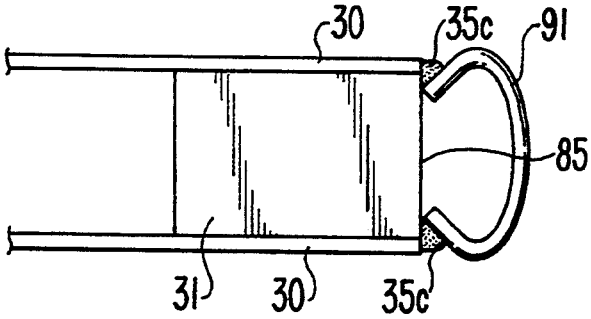
FIG. 15 is a view similar to FIG. 11 showing yet a further alternative connector arrangement but utilizing a retaining ring.

In the embodiment shown in FIG. 15, the outer edges of the plate 30 are flush with the outer edge surface 85 of the bar 30. A supplemental edge member or retaining ring 91, which is C-shaped in cross section and has a width substantially equal to the width of the plate and bar combination is located at the outer edge surface 85 of the bar with the leg portions of the open side of the seal bearing thereagainst. The supplemental edge member forms an edge cap, and seal welds 35*c* are then run in the acute angular space or wedge-shaped channels between the legs of the C-section of the retainer ring and the outer edges of the plate 30 and the outer edge surface 85 of the bar. The edges of the core outwardly of the bars 31 are thus more rounded.

Figure 16:
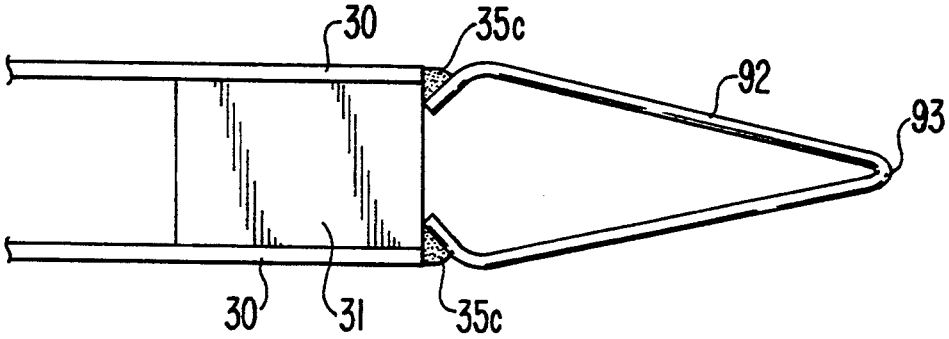
FIG. 16 is similar to FIG. 15 showing a connector arrangement utilizing a cap in place of the retaining ring of FIG. 15 for the purpose of improving gas flow through the core.

The embodiment shown in FIG. 16, has continuous seal welds 35*c* similar to that of FIG. 15. However, instead of providing a C-shaped retaining ring or edge cap 91, the embodiment in FIG. 16 Utilizes an elongated cap member which is of cone shape in cross section. The outer pointed edge or apex 93 of the elongated cap member 92 may be shaped with a small angle of about 10° to 12° to allow a smooth flow transition from the flow between the plates to the extended flow outside of the core. Such cap members located at both the inlet and outlet sides of the core relative to the gas flow result in a reduction in pressure drop or pressure losses of the gases passing through the core.

Figure 8:
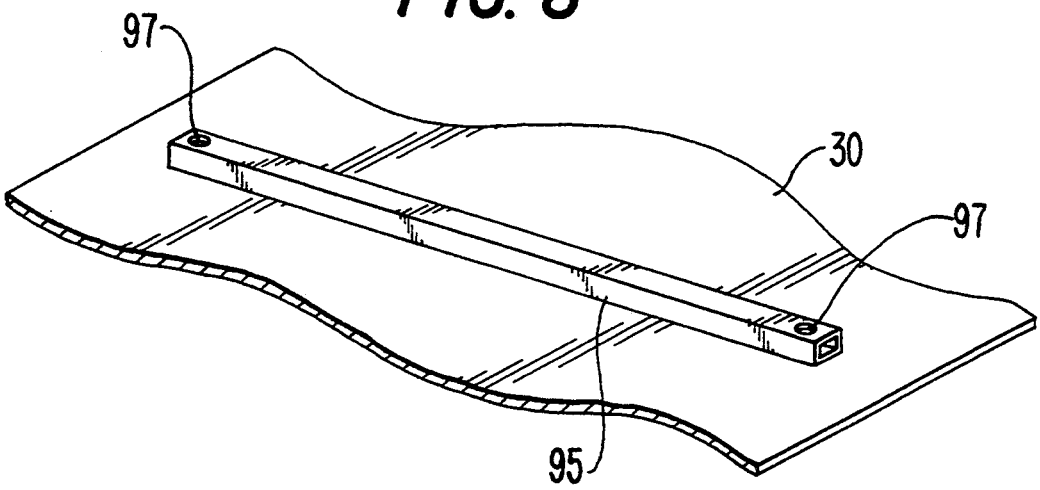
FIG. 8 is a perspective view illustrating a spacer member disposed between plate members making up the core.
Figure 9:
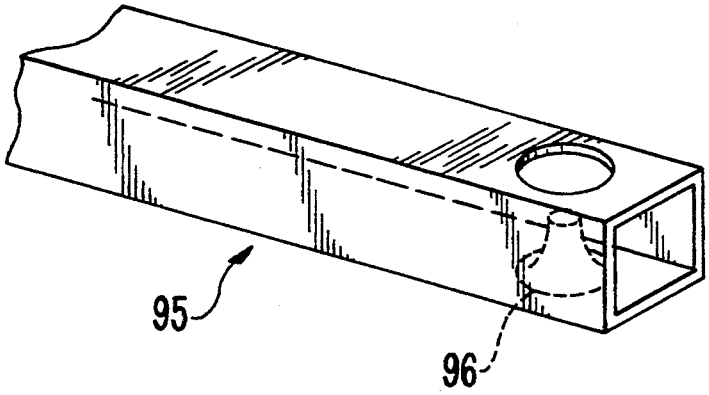
FIG. 9 is an enlarged perspective view of one end of the spacer of FIG. 8.
Figure 10:
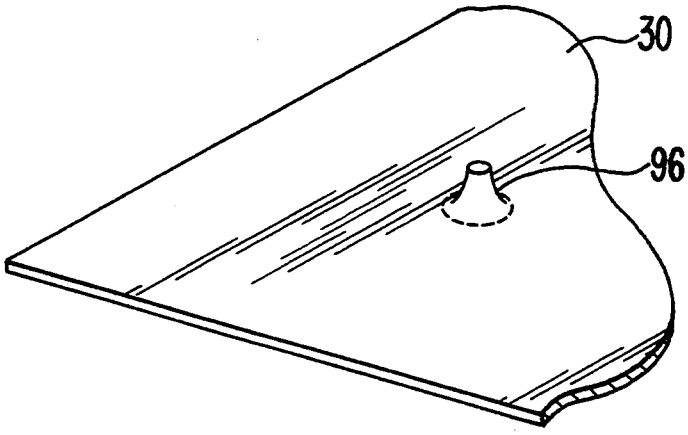
FIG. 10 is a perspective view of a plate member showing an embossment on one side of the plate member for cooperation with the spacer of FIG. 8.

As indicated above, the plates 30 may be formed of relatively weak steel plate material which may experience buckling. In order to eliminate the buckling, it is possible to position between the plates one or more spacers 95 as shown in FIG. 8. These spacers are of a thickness equal to the distance between opposed side surfaces of adjacent plates, and they extend in the direction of the fluid flow between the plates. The spacers 95, which may be formed of steel or from towel members of box cross section as shown in FIGS. 8 and 9. The spacers thus maintain a constant distance between the blades, and a sufficient number of spacers are provided in the space between each pair of adjacent plates distance less than the distance which would be critical for buckling. The spacers 95 are preferably not affixed to the plate members but are held in position by mating embossments 96 which are formed in conventional ways, such as stamping the embossment from the sheet material or building up an embossment by way of welding. Alternatively, separate embossment members could be made and welded to the plates. The spacer 95 is provided with openings 97 at least at opposite ends thereof for reception of the embossments 96.

While the above illustrated core structure has been described for use in a cross flow type which is normally considered to include an arrangement wherein the flow of one gas is substantially entirely at right angles to the flow of the other gas, it is apparent that the features of the core structure described above can also be used in a core structure wherein one gas path may have components which are not perpendicular to the flow path of the other but rather of a counter flow or parallel flow. For example the core may be elongated and the inlet area for one gas is disposed such that the gas flow is not-transversely through the plates to the outlet area which may be located longitudinally therefrom. The gas, after entering through the inlet area, changes direction approximately 90° and then flows in the direction of the elongation of the plates before again changing direction of about 90° and then exiting through the outlet. Moreover, while the outlet and inlet of one gas has been described as being on the fore and aft sides of the core, in the elongated structure the inlet and outlet areas may both be on one side, so that the gas enters at right angles relative to the plates of the inlet area, turns through about 90° and travels lengthwise through the elongated core before turning back through about 90° when exiting from the space between the plates at the outlet area which is on the same side of the core as the inlet area.

Although a number of features of applicant's preferred embodiment are shown, it will also be apparent to those skilled in the art that modifications may be made within the spirit of the invention as defined in the appended claims.

I claim:

1. A heat exchanger apparatus of the cross flow type comprising a rigid, unitary, parallelpiped shaped core; an integral frame containing said core; and seal means between said core and said frame;

said core being formed by attached, spaced, parallel, plates providing therebetween a plurality of alternating cross flow paths for two different gases, the flow path of a first gas of one temperature being horizontally through said core between fore and aft ends of the core and the flow path of a second gas of a different temperature being through said core between a first pair of opposite sides of said core disposed at a right angle to said fore and aft ends, said plurality of plates including a pair of outer plates and a plurality of innermost plates between the pair of outer plates, said outer plates having outer side surfaces defining a second pair of opposite sides of said core disposed at right angles to said ends and to said first pair of sides of said core, each inner plate being affixed to an adjacent plate on one side thereof at horizontal edges thereof by a first pair of elongated bars thereby defining with said adjacent plate on said one side a flow passage for said first gas between said fore and aft sides of said core, each inner plate being further affixed to an adjacent plate on the other side thereof at edges by a second pair of elongated bars disposed at right angles to said first pair of bars thereby defining with said adjacent plate on the other side a flow passage for the second gas between said second pair of opposite sides of said core, said core having four vertical corner edges, a pair of lower transverse corner edges and a pair of upper transverse corner edges;

said frame including a pair of panels joined by spaced elongated structural connectors, said panels being disposed adjacent the pair of outer plates of said core and having inner surfaces adjacent said outer side surfaces of said outer plates, said frame providing means supporting said core thereon and defining, (i) lower surface areas outwardly of said lower pair of transverse corner edges of said core, in the fore and aft directions, (ii) upper surfaces opposed to and spaced above the lower surface areas a distance greater than the height of said core to allow for expansion of said core in a vertical direction, and (iii) opposed inner side surface areas adjacent to but spaced transversely outward from said four vertical corners of said core for permitting transverse thermal expansion of said core;

said seal means being attached between said core and said frame and including:

a first set of seals including elongated seal members positioned between each of the vertical corner edges of said core and said inner side surface areas defined by said frame, a second set of seals including a pair of elongated seal members joining said upper transverse corner edges of said core and said upper surfaces of said frame, said first and second sets of seals permitting thermal expansion and contraction of said core in the transverse, vertical and fore and aft directions relative to said frame, and a third set of seals including a pair of elongated seals joining said lower transverse corner edges of said core to said lower surface area defined by said frame and permitting movement of said lower transverse corner edges in a fore and aft direction on said upper surface, and expansion and contraction of said lower transverse edges in a transverse direction relative to the lower surface areas of said frame, wherein said upper surface areas of said frame are defined by a first spaced pair of said structural connectors, and said lower surface areas of said frame are defined by a second spaced pair of said structural connectors, and wherein said second set of seals are disposed between said upper transverse corner edges of said core and said first pair of structural connectors, and said third set of seals are disposed between said lower transverse corner edges of said core and said second pair of structural connectors, and wherein said core defines vertical faces immediately adjacent said transverse corner edges and extending the width of said core, and said upper and lower surface areas of said structural connectors are disposed horizontally at right angles to said vertical faces of said core, wherein said structural connectors have means defining vertical faces projecting at right angeles from the horizontal surfaces and being spaced from and opposing one each of the vertical faces of said core, and wherein said elongated seal members of said second and third set of seals each extend transversely between the opposing vertical faces of said core and structural connectors of said frame, and wherein said elongated seal members of said second and third set of seals are formed of sheet spring steel and are of U-shaped cross section defined by a pair of opposed leg portions and a curved central portion.

2. An apparatus as defined in claim 1, wherein said leg portions of said elongated seal members terminate in parallel edges extending the length thereof, said leg portions of each elongated seal member being connected to the opposed vertical faces of said core and structural members, and further including seal welds between said parallel edges and said opposed faces running continuously the length of said elongated seal members.

3. An apparatus as defined in claim 1, wherein each elongated seal member includes a series of pressed-in grooves spaced along the length thereof, each groove being elongated in a direction transverse to the longitudinal direction of the elongated seal member and accommodating relative transverse expansion and contraction between said core and said structural connectors.

4. A heat exchanger apparatus of the cross flow type comprising a rigid, unitary, parallelpiped shaped core; an integral frame containing said core; and seal means between said core and said frame;

said core being formed by attached, spaced, parallel, plates providing therebetween a plurality of alternating cross flow paths for two different gases, the flow path of a first gas of one temperature being horizontally through said core between fore and aft ends of the core and the flow path of a second gas of a different temperature being through said core between a first pair of opposite sides of said core disposed at a right angle to said fore and aft ends, said plurality of plates including a pair of outer plates and a plurality of innermost plates between the pair of outer plates, said outer plates having outer side surfaces defining a second pair of opposite sides of said core disposed at right angles to said ends and to said first pair of sides of said core, each inner plate being affixed to an adjacent plate on one side thereof at horizontal edges thereof by a first pair of elongated bars thereby defining with said adjacent plate on said one side a flow passage for said first gas between said fore and aft sides of said core, each inner plate being further affixed to an adjacent plate on the other side thereof at edges by a second pair of elongated bars disposed at right angles to said first pair of bars thereby defining with said adjacent plate on the other side a flow passage for the second gas between said second pair of opposite sides of said core, said core having four vertical corner edges, a pair of lower transverse corner edges and a pair of upper transverse corner edges;

said frame including a pair of panels joined by spaced elongated structural connectors, said panels being disposed adjacent the pair of outer plates of said core and having inner surfaces adjacent said outer side surfaces of said outer plates, said frame providing means supporting said core thereon and defining, (i) lower surface areas outwardly of said lower pair of transverse corner edges of said core, in the fore and aft directions, (ii) upper surfaces opposed to and spaced above the lower surface areas a distance greater than the height of said core to allow for expansion of said core in a vertical direction, and (iii) opposed inner side surface areas adjacent to but spaced transversely outward from said four vertical corners of said core for permitting transverse thermal expansion of said core;

said seal means being attached between said core and said frame and including:

a first set of seals including elongated seal members positioned between each of the vertical corner edges of said core and said inner side surface areas defined by said frame, a second set of seals including a pair of elongated seal members joining said upper transverse corner edges of said core and said upper surfaces of said frame, said first and second sets of seals permitting thermal expansion and contraction of said core in the transverse, vertical and fore and aft directions relative to said frame, and a third set of seals including a pair of elongated seals joining said lower transverse corner edges of said core to said lower surface area defined by said frame and permitting movement of said lower transverse corner edges in a fore and aft direction on said upper surface, and expansion and contraction of said lower transverse edges in a transverse direction relative to the lower surface areas of said frame, wherein said upper surface areas of said frame are defined by a first spaced pair of said structural connectors, and said lower surface areas of said frame are defined by a second spaced pair of said structural connectors, and wherein said second set of seals are disposed between said upper transverse corner edges of said core and said first pair of structural connectors, and said third set of seals are disposed between said lower transverse corner edges of said core and said second pair of structural connectors, and wherein said core defines vertical faces immediately adjacent said transverse corner edges and extending the width of said core, and said upper and lower surface areas of said structural connectors are disposed horizontally at right angles to said vertical faces of said core, wherein said structural connectors have means defining vertical faces projecting at right angeles from the horizontal surfaces and being spaced from and opposing one each of the vertical faces of said core, and wherein said elongated seal members of said second and third set of seals each extend transversely between the opposing vertical faces of said core and structural connectors of said frame, and wherein stop means is affixed to said horizontal surface of said structural connectors and projects between the opposing vertical faces, said stop means having a face opposing an adjacent vertical face on said core and being spaced therefrom, said face of said stop means being positioned to be engaged by the adjacent vertical face of said core for thereby limiting relative movement of said core in said frame in the fore and aft direction.

5. A heat exchanger apparatus of the cross flow type comprising a rigid, unitary, parallelpiped shaped core; an integral frame containing said core; and seal means between said core and said frame;

said core being formed by attached, spaced, parallel, plates providing therebetween a plurality of alternating cross flow paths for two different gases, the flow path of a first gas of one temperature being horizontally through said core between fore and aft ends of the core and the flow path of a second gas of a different temperature being through said core between a first pair of opposite sides of said core disposed at a right angle to said fore and aft ends, said plurality of plates including a pair of outer plates and a plurality of innermost plates between the pair of outer plates, said outer plates having outer side surfaces defining a second pair of opposite sides of said core disposed at right angles to said ends and to said first pair of sides of said core, each inner plate being affixed to an adjacent plate on one side thereof at horizontal edges thereof by a first pair of elongated bars thereby defining with said adjacent plate on said one side a flow passage for said first gas between said fore and aft sides of said core, each inner plate being further affixed to an adjacent plate on the other side thereof at edges by a second pair of elongated bars disposed at right angles to said first pair of bars thereby defining with said adjacent plate on the other side a flow passage for the second gas between said second pair of opposite sides of said core, said core having four vertical corner edges, a pair of lower transverse corner edges and a pair of upper transverse corner edges;

said frame including a pair of panels joined by spaced elongated structural connectors, said panels being disposed adjacent the pair of outer plates of said core and having inner surfaces adjacent said outer side surfaces of said outer plates, said frame providing means supporting said core thereon and defining, (i) lower surface areas outwardly of said lower pair of transverse corner edges of said core, in the fore and aft directions, (ii) upper surfaces opposed to and spaced above the lower surface areas a distance greater than the height of said core to allow for expansion of said core in a vertical direction, and (iii) opposed inner side surface areas adjacent to but spaced transversely outward from said four vertical corners of said core for permitting transverse thermal expansion of said core;

said seal means being attached between said core and said frame and including:

a first set of seals including elongated seal members positioned between each of the vertical corner edges of said core and said inner side surface areas defined by said frame, a second set of seals including a pair of elongated seal members joining said upper transverse corner edges of said core and said upper surfaces of said frame, said first and second sets of seals permitting thermal expansion and contraction of said core in the transverse, vertical and fore and aft directions relative to said frame, and a third set of seals including a pair of elongated seals joining said lower transverse corner edges of said core to said lower surface area defined by said frame and permitting movement of said lower transverse corner edges in a fore and aft direction on said upper surface, and expansion and contraction of said lower transverse edges in a transverse direction relative to the lower surface areas of said frame, wherein said inner side surface areas of said frame are defined by elongated structural connectors, and said core defines faces immediately adjacent said vertical corner edges thereof and disposed at right angles to said inner side surface defined by said structural connections, wherein each structural connector has means defining a face projecting at a right angle from the inner side surface defined thereby and being spaced from and opposed to each of the face immediately adjacent the vertical corner of the core, and wherein each elongated seal member of said first set of seals is disposed between the opposed faces, and wherein said elongated seal member in said first set of seals is formed of sheet spring steel of U-shaped cross section defined by a pair of opposed leg portions and a curved central portion, and further including a pair of seal welds between each leg portion of the U-shaped seal and one of the faces of said opposed faces, said U-shaped elongated seal member having a plurality of transverse pressed-in grooves along the length thereof for accommodating expansion and contraction of said core in the vertical direction relative to said frame.

6. A heat exchanger apparatus of the cross flow type comprising a rigid, unitary, parallelpiped shaped core; an integral frame containing said core; and seal means between said core and said frame;

said core being formed by attached, spaced, parallel, plates providing therebetween a plurality of alternating cross flow paths for two different gases, the flow path of a first gas of one temperature being horizontally through said core between fore and aft ends of the core and the flow path of a second gas of a different temperature being through said core between a first pair of opposite sides of said core disposed at a right angle to said fore and aft ends, said plurality of plates including a pair of outer plates and a plurality of innermost plates between the pair of outer plates between the pair of outer plates;

said outer plates having outer side surfaces defining a second pair of opposite sides of said core disposed at right angles to said ends and to said first pair of sides of said core, each inner plate being affixed to an adjacent plate on one side thereof at horizontal edges thereof by a first pair of elongated bars thereby defining with said adjacent plate on said one side a flow passage for said first gas between said fore and aft sides of said core, each inner plate being further affixed to an adjacent plate on the other side thereof at edges by a second pair of elongated bars disposed at right angles to said first pair of bars thereby defining with said adjacent plate on the other side a flow passage for the second gas between said second pair of opposite sides of said core, said core having four vertical corner edges, a pair of lower transverse corner edges and a pair of upper transverse corner edges;

said frame including a pair of panels joined by spaced elongated structural connectors, said panels being disposed adjacent the pair of outer plates of said core and having inner surfaces adjacent said outer side surfaces of said outer plates, said frame providing means supporting said core thereon and defining, (i) lower surface areas outwardly of said lower pair of transverse corner edges of said core, in the fore and aft directions, (ii) upper surface opposed to and spaced above the lower surface areas a distance greater than the height of said core to allow for expansion of said core in a vertical direction, and (iii) opposed inner side surface areas adjacent to but spaced transversely outward from said four vertical corners of said core for permitting transverse thermal expansion of said core;

said seal means being attached between said core and said frame and including:

a first set of seals including elongated seal members positioned between each of the vertical corner edges of said core and said inner side surface areas defined by said frame, a second set of seals including a pair of elongated seal members joining said upper transverse corner edges of said core and said upper surfaces of said frame, said first and second sets of seals permitting thermal expansion and contraction of said core in the transverse, vertical and fore and aft directions relative to said frame, and a third set of seals including a pair of elongated seals joining said lower transverse corner edges of said core to said lower surface area defined by said frame and permitting movement of said lower transverse corner edges in a fore and aft direction on said upper surface, and expansion and contraction of said lower transverse edges in a transverse direction relative to the lower surface areas of said frame, wherein said panels are vertically disposed and said inner side surface areas of said frame are defined by said panels, and said core defines vertically extending surfaces adjacent each of said four vertical corner edges spaced from and parallel to said inner side surface areas of said frame, and wherein each elongated seal member of said first set of seals is positioned between the surface defined by said core and an adjacent core of the side surface areas of the frame, and wherein each of said elongated seal members of said first set is formed of spring steel and in cross section is defined by a pair of side flanges joined by a central portion, said side flanges being in different parallel planes, one flange being affixed to the surface defined by said core and the other affixed to the adjacent one of the side surface areas of the frame.

7. An apparatus as defined in claim 6, said central portion of said elongated seal member of said first set is of Z-shaped cross section.

8. An apparatus as defined in claim 6, wherein said central portion of said elongated seal member of said first set in cross section is formed of two portions formed each integrally along the outside thereof to one of said flanges and formed integrally along the inside thereof to each other at an angle, each of said two portions extending away from its associated flange at an angle for thereby accommodating movement of said core relative to said frame in the transverse and fore and aft directions.

9. An apparatus as defined in claim 7, wherein said elongated seal member of said first set has a plurality of pressed in transversely extending grooves spaced along the length thereof for accommodating movement of said core relative to said frame in the vertical direction.

10. An apparatus as defined in claim 6, wherein said side flanges have side edges and further including seal welds formed continuously between the edge of one of the flanges and said inner side surface area of said frame and the edge of the other flange and surface defined at the adjacent corner edge of said core said adjacent vertically extending surfaces of said core.

* * * * *